United States Patent [19]

Ostapovitch

[11] 4,076,369

[45] Feb. 28, 1978

[54] BOX TERMINAL FOR CARD EDGE RECEPTACLES IN TELECOMMUNICATIONS SYSTEMS AND THE LIKE

[75] Inventor: Harold Joseph Ostapovitch, Lachine, Canada

[73] Assignee: Northern Telecom Limited, Montreal, Canada

[21] Appl. No.: 708,628

[22] Filed: Jul. 26, 1976

[51] Int. Cl.[2] ..... H01R 13/12

[52] U.S. Cl. ..... 339/258 R

[58] Field of Search ..... 339/258

[56] References Cited

U.S. PATENT DOCUMENTS

| | | | |
|---|---|---|---|
| 3,417,362 | 12/1968 | Reynolds | 339/258 S |
| 3,786,401 | 1/1974 | Jones et al. | 339/258 R |
| 3,853,389 | 12/1974 | Occhipinti | 339/258 R |
| 3,963,302 | 6/1976 | Gourley | 339/258 R |

FOREIGN PATENT DOCUMENTS

| | | | |
|---|---|---|---|
| 2,230,151 | 12/1974 | France | 339/258 P |
| 1,909,416 | 11/1970 | Germany | 339/258 R |
| 1,294,485 | 10/1972 | United Kingdom | 339/258 R |

*Primary Examiner*—Joseph H. McGlynn
*Attorney, Agent, or Firm*—Sidney T. Jelly

[57] ABSTRACT

A box terminal, particularly for card edge receptacles in telecommunications systems is in the form of a hollow box structure having opposed lever arms with contact areas at the ends of the arms, and with opposed formations on a plane normal to the plane containing the lever arms. The opposed formations restrict lateral displacement of a pin entering the box and, with the beams, restrict rotational displacement of a pin. Contact occurs on at least two prime surfaces, that is on flat surfaces. The beams are preloaded to control insertion forces.

5 Claims, 22 Drawing Figures

BOX TERMINAL FOR CARD EDGE RECEPTACLES IN TELECOMMUNICATIONS SYSTEMS AND THE LIKE

This invention relates to box terminals for card edge receptacles, such as are used in switching systems in telephone and other communication systems.

Box terminals are used to make contact with square pins, which are themselves terminals for connection of conductors thereto. It is desirable to keep card insertion forces as low as possible while a large number of connections are usually made. For example a maximum force of 40 lb. is desired, while making 200 connections. At the same time it is necessary to ensure contact forces of a sufficiently high value as to ensure good contact between pin and box terminal. Contact forces largely determine card insertion forces, together with the smoothness of the contact surfaces.

It is likely that the pins will be rotated about their longitudinal axis as much as 10°, due to manufacture and/or insertion of pins in a board or other item. Also a lateral displacement is likely to occur. This rotation, and displacement, results in contact occurring on the corners of the pin. This is undesirable for various reasons, such as limited contact area and difficulty in providing good noble metal plating on corners.

The present invention provides a construction for the box terminal in which contact occurs on a prime surface of the pin even when the pin is rotated or displaced. Essentially, a box terminal has lever arms in opposition with contact areas at the ends of the arms, to make contact on opposite faces of a pin, and opposed formations on a plane normal to that of the lever arms to provide control over rotation and displacement of the pin relative to the box terminal.

The invention will be readily understood by the following description of certain embodiments by way of example, in conjunction with the accompanying drawings, in which.

Figure 2:
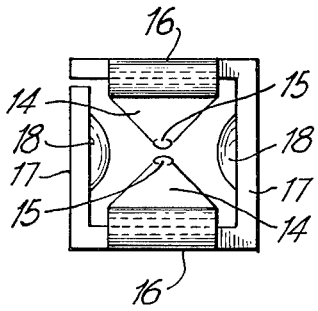
FIGS. 1 and 2 are diagrammatic side and end views respectively of one form of box terminal.
Figure 1:
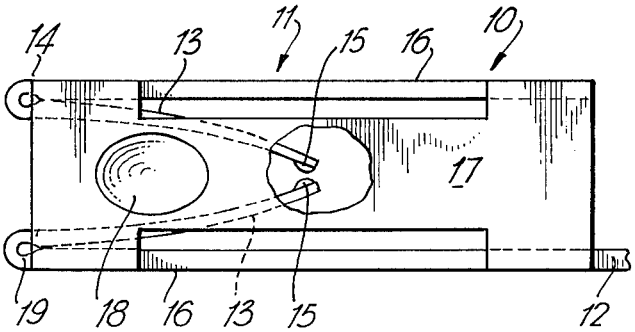

In the example illustrated diagrammatically in FIGS. 1 and 2, a box terminal 10 is formed from a blank which is folded to produce a four sided box portion 11 and a tail portion 12 to which a conductor can be connected. Two cantilevered beams 13 extend from the end 14 of the box portion remote from the tail portion 12, the beams 13 in opposition inside the box portion 11 and having domed contact areas 15. The beams are conveniently formed integral with two of the sides 16 of the box portion 11. The two other sides 17 of the box portion 11 have domed portions 18 formed therein. Domed portions 18 are in opposition to each other and, in the example illustrated, are nearer to the end 14 of the box portion than the contact areas 15.

Initially, the contact areas 15 are in contact, or closely spaced. On insertion of a terminal pin, the beams 14 are spread apart. As seen in FIG. 1, the beams 14 are bent over from the related sides 16. The cross-section of the metal is reduced at the bend 19 to give a more flexible joint. Also the beams 14 are curved and move successively more and more into contact with the related side, giving a variable fulcrum position which moves down from the bend 19 towards the contact area 15 as the beam is pushed outward by the pin. Thus the force of the beam on the pin increases as the pin is inserted.

Figure 3:
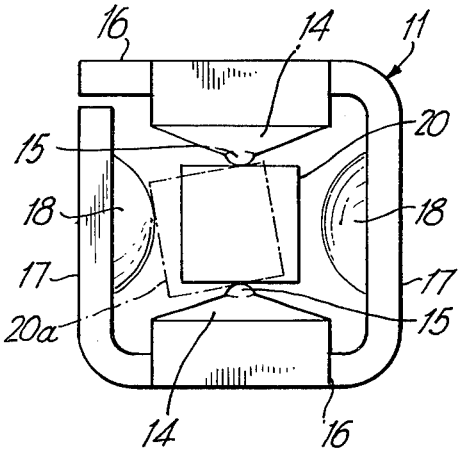
FIG. 3 is a diagrammatic end view of a box terminal, as in FIGS. 1 and 2, illustrating the contact conditions with a pin.

The arrangement will accept both lateral displacement of a pin from its true position and also some rotation of a pin. FIG. 3 illustrates diagrammatically the situation in a box terminal when a pin has both rotational and lateral displacement. The domed portion 18 limits the lateral movement or displacement, while the flexibility of the beams accepts the additional bending resulting from the rotation of the pin indicated in full outline at 20 for a properly positioned pin and in dotted outline at 20*a* for a rotational and lateral displacement.

Figure 5:
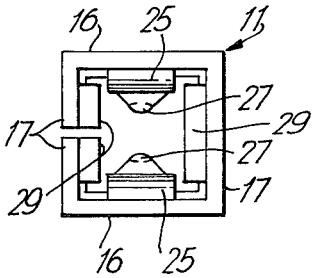
FIGS. 4 and 5 are diagrammatic side and end views respectively of another form of box terminal.
Figure 4:
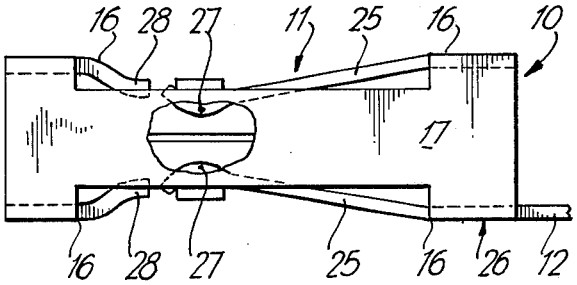

FIGS. 4 and 5 illustrate an alternate form of box terminal 10, again having a box portion 11 and a tail portion 12 and four sides, in opposed pairs 16 and 17. In this particular example the sides 16 are themselves formed to produce cantilevered beams 25. The beams 25 extend from the end 26 of the box portion 11 from which the tail portion 12 extends. The ends of the beams 25 have domed contact areas 27. The remaining portions 28 of the sides 16 are also bent inward to form guide portions.

Figure 6:
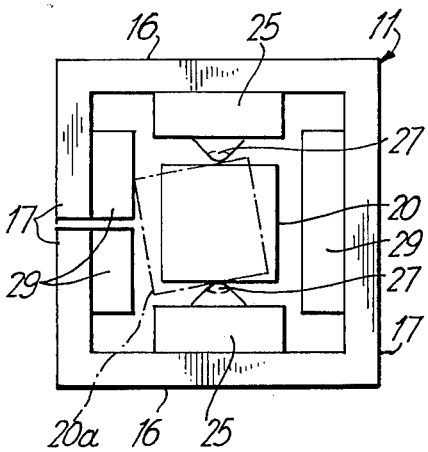
FIG. 6 is a diagrammatic end view of a box terminal, as in FIGS. 4 and 5, illustrating the contact conditions with a pin.

The sides 17 are pressed inward at a position 29 intermediate their ends to produce further guide portions — similar to the domed portions 18 in FIGS. 1, 2 and 3. This, with the inward inclination of the beams 25, gives the box portion 11 a waisted configuration. The structure acts in a similar manner to that of FIGS. 1, 2 and 3. As a pin terminal is inserted into the box portion 11 the beams 25 are pushed apart, the pin being guided by the portions 28. The sides 17, where pressed in at 29, act to restrict lateral displacement of the pin. As seen in FIG. 6 the portions 29 limit lateral displacement and the beams 25 accept the additional spreading necessary as a result of rotation of the pin, in full outline at 20 and dotted outline at 21, as in FIG. 3.

It will be seen from FIGS. 3 and 6 that at all times contact with the pin occurs always on a prime surface — that is a flat surface — indeed on two flat surfaces. The pin is always prevented from being excessively laterally displaced, relative to the contact areas 15 and 27, to ensure contact on a flat surface. The box terminals will accept up to at least 10° rotation and still provide contact on two flat faces of the pin, even with some lateral displacement of the pin.

Figure 7:
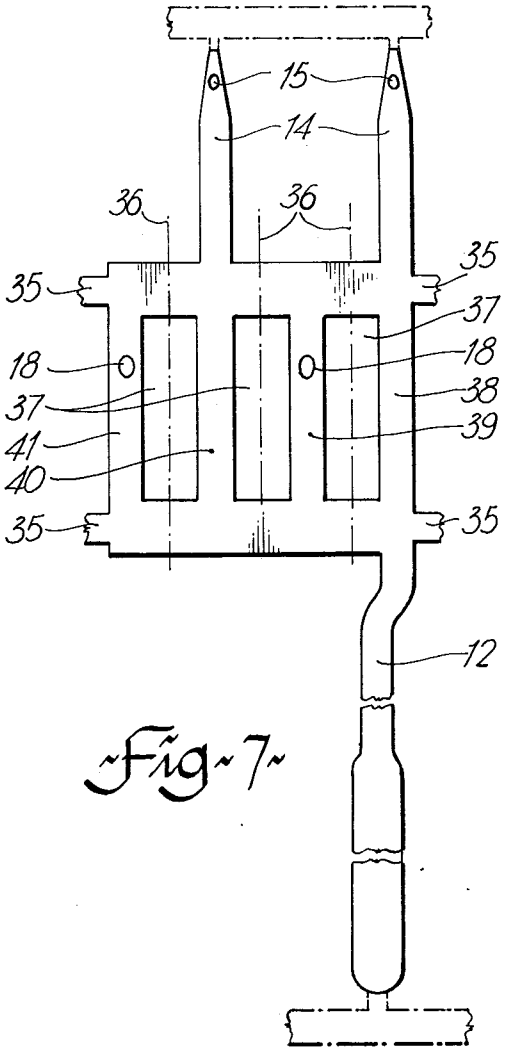
FIG. 7 is a plan view of a blank for the box terminal of FIGS. 1 and 2.

FIG. 7 illustrates a form of blank for making a box terminal of the form illustrated in FIGS. 1, 2 and 3, and FIGS. 8 to 11 illustrate in more detail a box terminal as in FIGS. 1, 2 and 3. The same references are used in FIGS. 7 to 12 as used in FIGS. 1 to 3, for the same details.

In the blank, FIG. 7, the beams 14 extend from one edge while the tail 12 extends from the opposite edge. The blanks are formed in a strip, each blank being attached to adjacent blanks by thin webs 35 which are sheared when the blank is formed. The beams are coined or otherwise worked to thin the material at the position of the bend 19 and then the beams 14 are bent over to lie in close proximity with the associated side 16. The beams are arcuate to give a variable pivot position, and thus variable beam length as previously described. The blank is then formed by bending along the chain dotted lines 36 passing through apertures 37 in the blank between ribs 38 to 41.

Figure 8:
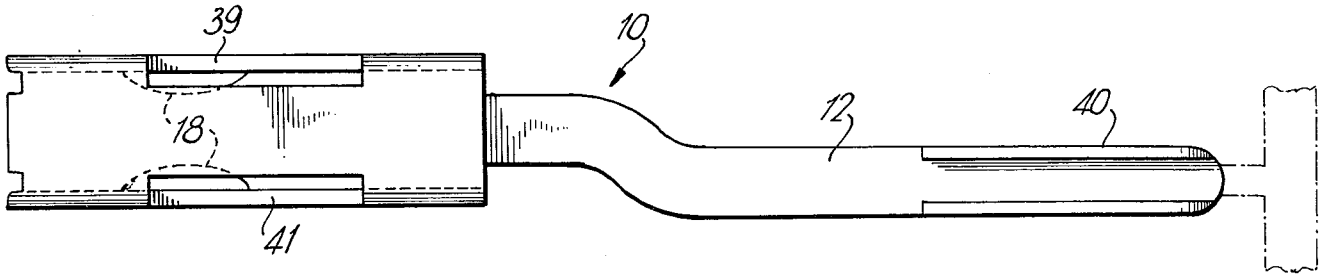
FIGS. 8, 9 and 10 are detailed plan, side and end views of a box terminal as diagrammatically illustrated in FIGS. 1 and 2.
Figure 9:
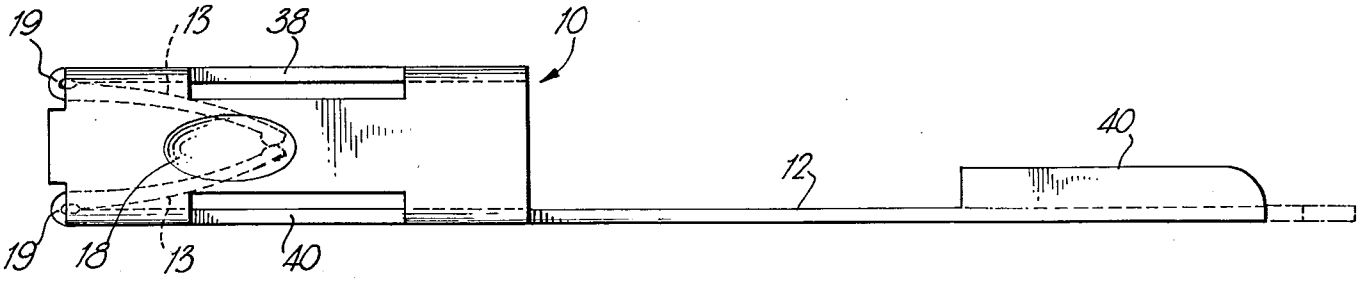
Figure 10:
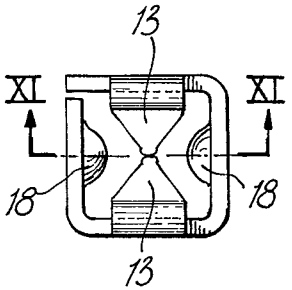

The formed terminal is illustrated in detail in FIGS. 8 to 11. As seen in FIG. 8, the tail 12 is offset sideways. This serves to locate the terminal in the particular connector body. The tail 12 can be formed at its end, at 40, to provide a locating groove to which a conductor is soldered. As seen in the end view, FIG. 10, the blank is bent round until its two edges abut. The provision of the apertures 37 assists in easy forming of the blank. The beams 14 extend inside the terminal, initially in contact with opposed ribs 38 and 40 but arcing inwards towards each other. This is seen in FIG. 9, where the beams are shown in dotted outline, and also in the end view, FIG. 10.

Figure 11:
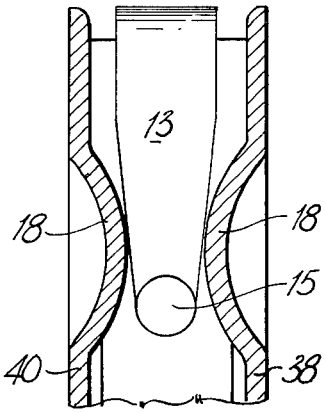
FIG. 11 is a cross section on the lines XI—XI of FIG. 10.

The contact portions 15 can be formed in various ways, for example by dimpling the ends of the beams, the raised surface afterwards being gold plated. An alternative is to weld a gold spot on to the end of the beam to provide a domed contact area. The cross-section of FIG. 11 illustrates the inward doming or dimpling of the opposed ribs 39 and 41 to form guide members when a pin is inserted. The dimpling of the ends of the beams 14 and of the ribs 39 and 41 can be done immediately prior to forming of the blank into a terminal. The dimpling positions are indicated in FIG. 7 at 15 and 18. Conveniently, the box terminals are formed from strip, in multi-stage dies for example, in which the blank is progressively formed and then the terminal formed. The finished terminals are then sheared from the strip. The points of attachment to the strip are indicated by dotted lines 60 in FIGS. 7 and 8.

Figure 12:
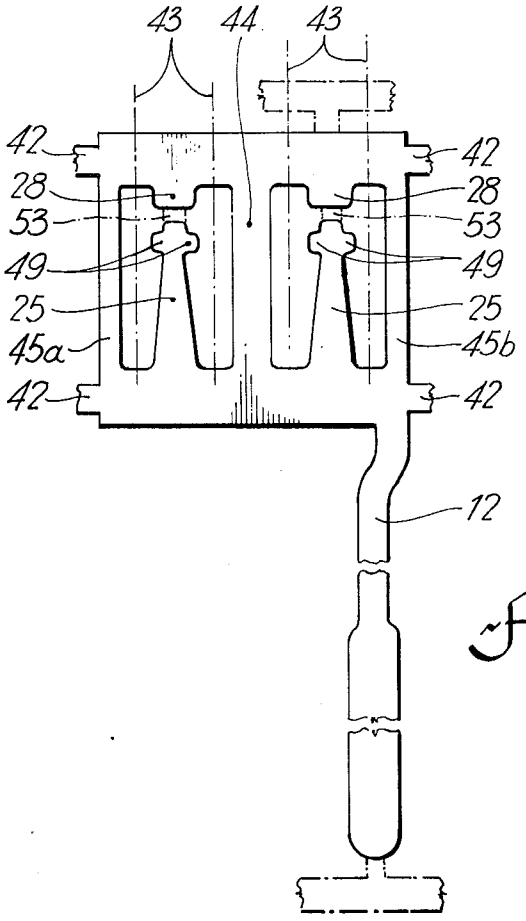
FIG. 12 is a plan view of a blank for the box terminal of FIGS. 4 and 5.
Figure 18:
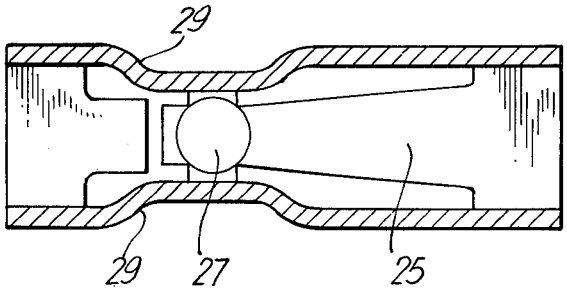
FIGS. 16, 17 and 18 are cross-sections on the lines XVI—XVI of FIG. 14, line XVII—XVII of FIG. 14, and line XVIII—XVIII of FIG. 13 respectively.
Figure 13:
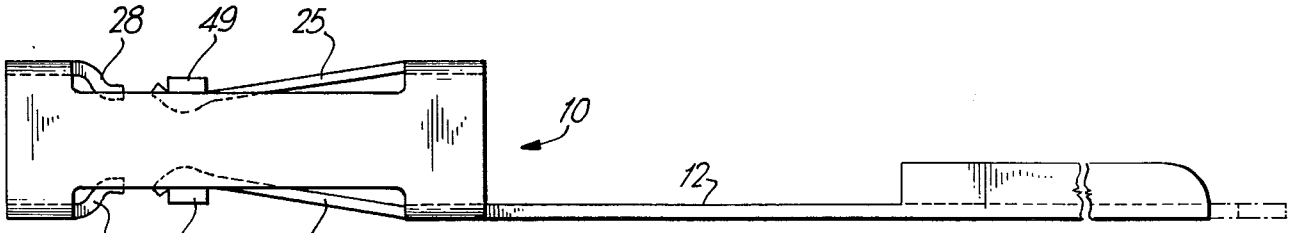
FIGS. 13, 14 and 15 are detailed plan, side and end views of a box terminal as diagrammatically illustrated in FIGS. 4 and 5.
Figure 14:
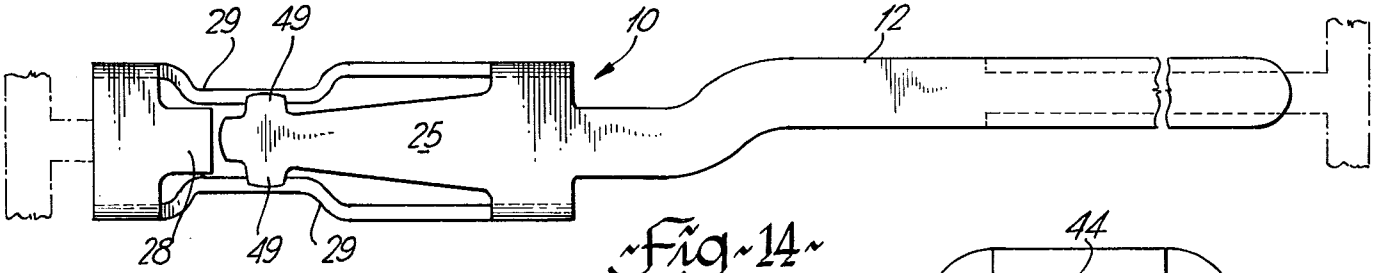
Figure 16:
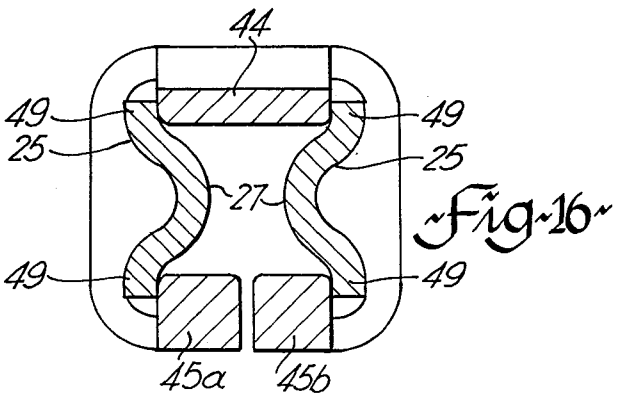
Figure 15:
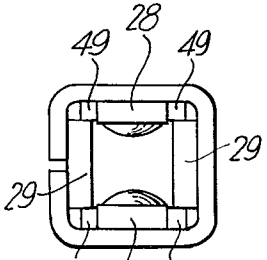
Figure 17:
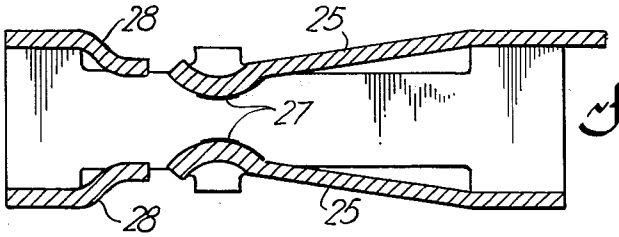

FIG. 12 illustrates a typical blank for a box terminal of the form illustrated in FIGS. 4, 5 and 6, and FIGS. 13 to 18 illustrate in more detail a box terminal as in FIGS. 4, 5 and 6. The blanks are formed in a strip, each blank being attached to adjacent blanks by thin webs 42 which are removed when the blank is formed. The positions of the beams 25 are seen and also the portions 28. The blank is formed or bent along lines indicated by the chain dotted lines 43. Apertures 48 are formed in the blank, the bend lines passing through the apertures. Prior to forming of the blank, the ends of the beams 25 are domed to provide the contact areas 27. These contact areas can be gold plated. Also prior to forming the ribs 44 and 45*a* and 45*b* are bent to give the waisted cross-section, as seen in FIG. 18.

The beams 25 have short laterally extending portions 49 adjacent to the contact areas 27. As the blank is formed, after doming of the ends of the beams 25, the beams are bent inwards but the laterally extending portions 49 overlie the waisted or inwardly bent portions 29 of the ribs 44 (forming the sides 17 of FIGS. 4, 5 and 6). The beams 25 are given a preload inwardly at forming but are prevented from extending in too far by the engagement of the portions 49 with the portions 29. This reduces initial insertion forces and also prevents butting of the pin end against the contact area 27. Again the terminals can be formed from strip, and the points of attachment to the strip, of the finished terminals are indicated by dotted lines 61 in FIGS. 12 and 14.

The portions 28 are also bent inward to form short arcuate sections. These sections act as guide members when a pin enters the terminal — from the left hand end as seen in the drawings. Similarly the inwardly formed portions of ribs 44, 45*a* and 45*b* also act as guide members. The inwardly formed portions of the ribs also act to constrain the pin, limiting any lateral displacement to a maximum predetermined amount. As a pin enters the terminal, it deflects the beams 25, the contact areas 27 moving in contact with prime surfaces (i.e. flat surfaces) on the pin.

Figure 20:
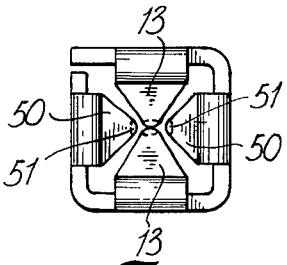
FIGS. 19, 20 and 21 are diagrammatic side, plan and end views of a modification to the box terminal illustrated in FIGS. 1 and 2.
Figure 19:
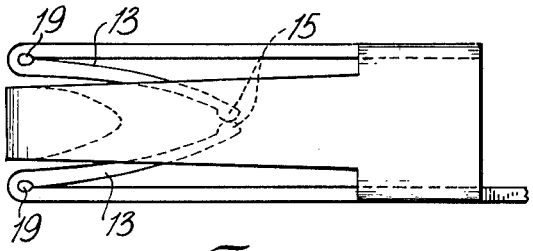
Figure 21:
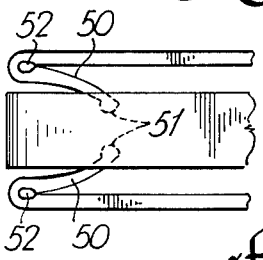

The embodiments described above are two examples of the present invention. Modification can be made to the terminals described, still with the basic requirement and/or lateral displacement of a pin relative to the terminal and also having contact on prime surfaces. FIGS. 19, 20 and 21 illustrate one modification to the box terminal as illustrated in FIGS. 1 to 3 and FIGS. 8 to 11. In this modification, the domed portions 18 are replaced by two further beams 50. Beams 50 are extensions of ribs 39 and 41 and are bent over prior to forming of the blank into a box terminal, in the same manner as beams 14. The ends of beams 50 are domed to form contact areas 51. The material is reduced in thickness at the bend 52, as for the beams 14. The beams 50 act as guides and constraining members to prevent undue lateral displacement.

Figure 22:
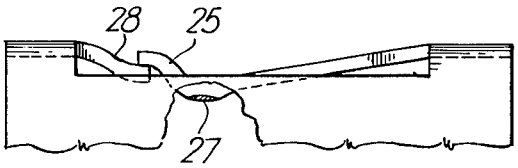
FIG. 22 is a diagrammatic partial side view illustrating a modification to the box terminal illustrated in FIGS. 4 and 5.

FIG. 22 illustrates a modification of the terminal illustrated in FIGS. 4, 5 and 6 and FIGS. 17 and 18. In this modification, instead of the beams 25 having laterally extending portions 49, the ends of the beams are arranged to overlie the portions 28. This is obtained by the overall shortening of the box portion of the terminal resulting from the waisting during forming. The ends of the beams 25 will be immediately adjacent to the ends of the portions 28, after shearing, as indicated by dotted lines 53 in FIG. 12.

The box terminals will accept pins having both rotational and lateral displacement in excess of that which will enable good contacts to be made on a prime surface. The entrance to the box portion of the terminal is considerably larger than the dimensions of the pins to be inserted. The various guiding and restraining surfaces bring the pins into positions which are within the limits acceptable for good contact. The tails 12 can be of differing lengths, depending upon installation requirements, and can be given different forms.

The provision of contact areas on prime surfaces of a pin enables contact pressures to be kept low. Also, the contact surfaces are smooth, remain smooth and even become burnished, so that frictional forces are low. This means that insertion and withdrawal forces of cards are low. Contact making conditions are consistent and of high quality, and remain so for very many insertions and withdrawals. The formation of the beams, in the various arrangements, provides controlled, predetermined, consistent contact forces between beams and pins. This enables contact forces to be lower than with conventional arrangements, where contact forces can vary thus requiring that the design be such that under all conditions minimum contact pressure shall occur. This results in high contact pressures occurring in many instances.

What is claimed is:

1. A box terminal, for reception of a rectangular terminal pin, including a main body box portion and a tail portion;

the main body portion of elongate form having a rectangular cross-section normal to the longitudinal axis, and including an entry end and an exit end, said tail portion extending from said exit end;

said main body portion having four side members forming first and second pairs of side members, the side members of a pair in opposition;

the first pair of side members being cantilevered from the exit end and resiliently biased inwardly to form cantilever spring contact members, each having a free end extending towards said entry end, and a domed contact area adjacent to the free end of each spring contact member;

means restricting inward deflection of said spring contact members to provide a preloaded bias on said contact members; and the second pair of side members deformed inwardly intermediate the ends of the side members to form said pin engaging formations, each formation including an inwardly inclined surface positioned toward said entry end.

2. A box terminal as claimed in claim 1, including guide means at said entry end aligned with said spring contact members, each of said guide means including an inwardly inclined surface extending inwards beyond the free end of said spring contact members.

3. A box terminal as claimed in claim 1, said cantilever spring contact members each including at least one extension adjacent said contact area, said extension overlying a further part of said box portion to restrict inward movement of said cantilever spring contact members.

4. A box terminal as claimed in claim 3, said cantilever spring contact members each including a laterally extending extension on each side thereof, said lateral extension overlying said second pair of members.

5. A box terminal as claimed in claim 3, an extension extending from the free end of each of the spring cantilever members and overlying a portion of the related side.

* * * * *